US005931464A

United States Patent [19]

Shimizu et al.

[11] Patent Number: 5,931,464

[45] Date of Patent: Aug. 3, 1999

[54] SHEET SORTING DEVICE HAVING SHEET PRESSURE MEMBERS

[75] Inventors: Masao Shimizu, Kofu; Hiroshi Kaneda, Amimachi, both of Japan

[73] Assignee: Nisca Corporation, Yamanashi-ken, Japan

[21] Appl. No.: 08/855,793

[22] Filed: May 12, 1997

[30] Foreign Application Priority Data

May 13, 1996 [JP] Japan ..... 8-117518

[51] Int. Cl.[6] ..... B65H 39/10; B65H 31/26

[52] U.S. Cl. ..... 271/296; 271/300; 271/302; 271/220; 271/298

[58] Field of Search ..... 271/296, 300, 271/302, 220, 298

[56] References Cited

U.S. PATENT DOCUMENTS

| | | | |
|---|---|---|---|
| 4,408,756 | 10/1983 | Miyashita et al. | 271/296 |
| 4,498,665 | 2/1985 | Watanabe | 271/296 |
| 4,576,371 | 3/1986 | Takahashi et al. . | |
| 5,026,034 | 6/1991 | Russell et al. | 271/220 |
| 5,033,731 | 7/1991 | Looney | 271/220 |
| 5,324,024 | 6/1994 | Mori | 271/296 |
| 5,390,910 | 2/1995 | Mandel et al. | 271/296 |
| 5,449,158 | 9/1995 | Hirota et al. | 271/296 |

FOREIGN PATENT DOCUMENTS

| | | | |
|---|---|---|---|
| 360056766 | 4/1985 | Japan | 271/220 |
| 1231756 | 9/1989 | Japan . | |
| 1231757 | 9/1989 | Japan . | |
| 0106551 | 4/1990 | Japan | 271/220 |
| 4-67994 | 3/1992 | Japan . | |
| 4-72271 | 3/1992 | Japan . | |
| 4361092 | 12/1992 | Japan . | |
| 2224010 | 4/1990 | United Kingdom | 271/220 |

*Primary Examiner*—William E. Terrell
*Assistant Examiner*—Wonki Park
*Attorney, Agent, or Firm*—Kane, Dalsimer, Sullivan, Kurucz, Levy, Eisele and Richard, LLP

[57] ABSTRACT

In a sheet sorting device for distributing sheets consecutively fed from an image forming device such as a copying machine to sorting trays aligned in multiple stages at high speed, there are disposed sheet pressure members for pressing down preceding sheet or sheets previously introduced into the designated sorting tray so as to successfully introduce the following sheet into the designated sorting tray without being hindered by the preceding sheet or sheets on the designated sorting tray. Since the following sheet is in no way hindered by the preceding sheet on the sorting tray in entering into the designated tray by means of the sheet pressure members, the interval between the adjoining sorting trays can be reduced thus to diminish the sorting device in size.

12 Claims, 8 Drawing Sheets

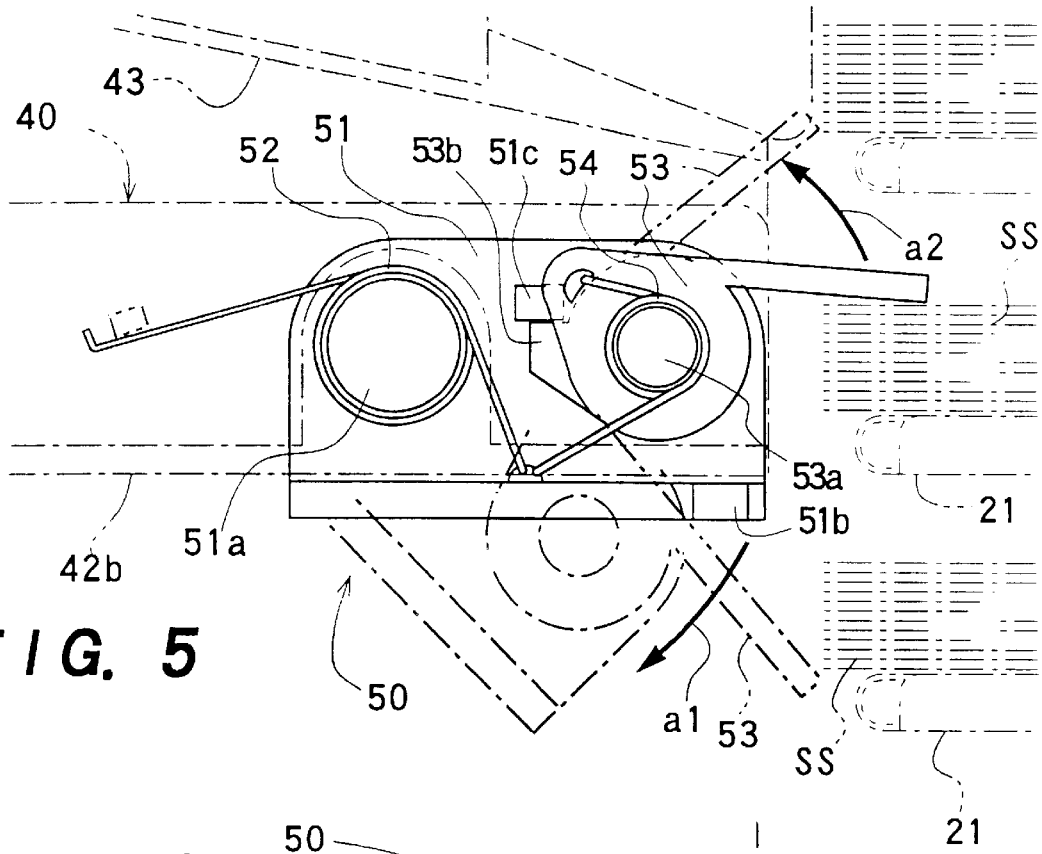
FIG. 5
FIG. 6
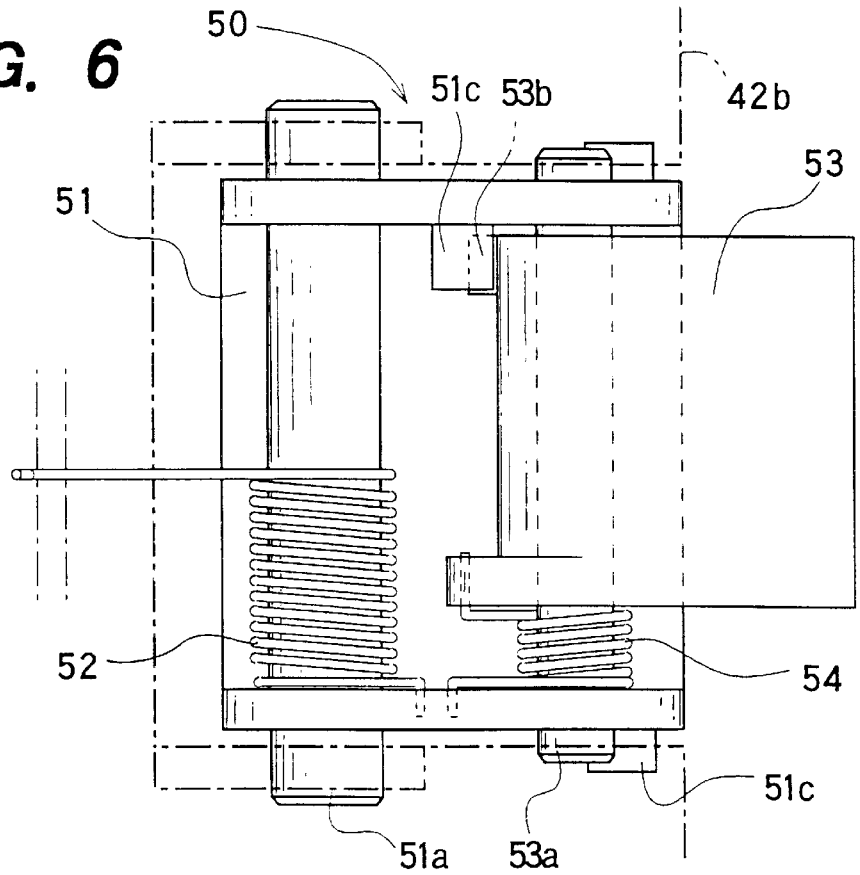

SHEET SORTING DEVICE HAVING SHEET PRESSURE MEMBERS

BACKGROUND OF THE INVENTION

1. Field of the Invention

This invention relates to a device for sorting sheets discharged consecutively from an image forming device such as a copying machine to collate the sheets into sets in paging order, and more particularly to an automatic sheet sorting device having sheet pressure members for preventing interference of the sheets discharged from the image forming device with the sheets introduced previously into multi-stage sorting trays.

2. Description of the Prior Art

There has been used a sheet sorting device (sorter) for automatically distributing copy sheets or printed sheets consecutively discharged from an image forming device such as a copying machine, printing machine and printer into sorting trays aligned in multiple stages while collating the sheets in paging order. That is, a plurality of copy sheets or printed sheets reproduced from one original are fed one by one to the respective sorting trays in order, thus forming sets of copy sheets put in order of page. This sheet sorting device is applied as a finishing system or bookbinding system for the image forming device.

Although the number of copies can be increased with increasing the sorting trays in number, the increase of the sorting trays adds to the size of the sorting device. There are not infrequently found sorting devices having several tens of sorting trays aligned vertically, in which the interval between the adjoining sorting trays is conventionally reduced to diminish the size of the device.

However, the sheet discharged from the image forming device is not always flat, and particularly, it discharged from the copying machine, laser printer or the like, in which images formed with toner are fixed with heat, is by and large curled or deformed, consequently entailing a disadvantage such that the sheets are not neatly ensconced in the sorting tray and impedes successful admission of the following sheet into the sorting tray.

In a sorting device described in U.S. Pat. No. 4,576,371, a copy sheet is positively curved with its middle portion rising so as not to interrupt the next copy sheet, by using a pair of feed rollers different in diameter which are disposed confronting the entrance of a sorting tray. However, since the sheet is curved by the feed rollers before entering the sorting tray, it is apt to be caught by the entrance of the sorting tray or interrupted by the rising middle portion of the sheet earlier introduced into the sorting tray. Consequently, the interval between the vertically adjoining sorting tray cannot be narrowed, resulting in a large overall size.

As another measure, the sorting tray may be provided with electrical sheet pressure members which are operated by electric actuators for pressing down the sheets stacked on the sorting tray, and resultingly, it is complicated in structure and calls for an advanced controlling system which renders the handling of the device difficult.

Thus, there has been a need for a sheet sorting system capable of rationally and reliably distributing and sorting the sheets into the respective sorting trays at high speed without entailing problem such as increase in device size.

OBJECT OF THE INVENTION

An object of the present invention is to provide a sheet sorting device capable of stably and reliably sorting and distributing sheets into multi-stage sorting trays at high speed without causing a sheet jam or other possible misfeeding.

Another object of the invention is to provide a sheet sorting device having multi-stage sorting trays aligned at the minimum intervals so as to diminish the device size, and simple sheet pressure members capable of completely preventing the sheets from interfering with each other.

Still another object of the invention is to provide a sheet sorting device having sheet pressure members capable of effectively holding down the sheets stacked on the sorting tray when introducing the sheet, which can easily be assembled into a high-speed sheet transport system including sorting trays held horizontally in parallel and aligned vertically in multiple stages and a sheet inductor for introducing the sheet into a designated sorting tray, so that the sheet inductor can be moved along the aligned sorting trays without hindrance.

SUMMARY OF THE INVENTION

To attain the objects described above according to this invention, there is provided a sheet sorting device comprising sorting trays aligned in multiple stages for receiving sheets, means for transporting the sheet, a sorting unit including a sheet inductor for introducing the sheet into the sorting tray designated, and means for driving the sheet inductor along the aligned sorting trays, and sheet pressure members disposed on the sheet inductor.

The sheets consecutively given from an image forming device are successively sent into the respective sorting trays. The sheet pressure member presses down the preceding sheet previously introduced into the designated sorting tray, when the sheet inductor confronts the designated sorting tray to introduce the following sheet into the sorting tray. Thus, the following sheet can be duly introduced into the designated sorting tray without being hindered by the preceding sheet stacked on the sorting tray.

The sorting trays are held in their substantially horizontal posture and aligned vertically in multiple stages. The sheet inductor moves stepwise along the sheet receiving portion defined at one ends of the sorting trays, and stops confronting the sorting trays one by one to introduce the sheets fed successively into the respective sorting trays.

The sheet pressure member comprises a rocking frame supported rotatably on the sheet inductor, and a pressure flap supported rotatably on the rocking frame.

The rocking frame is energized by a first spring so as to usually assume its substantially horizontal posture, and stoops down against the first spring when the sheet inductor moves upward. The pressure flap is energized by a second spring so as to usually assume its substantially horizontal posture, and turn upward against the second spring when the sheet inductor moves downward. Thus, when the sheet inductor moves up and down, the sheet pressure member evades the sheets stacked on the sorting tray so as not to impede the vertical movement of the sheet inductor.

The sheet transporting means includes feed belts arranged along the path for moving the sheet inductor, and serves to transport the sheet at high speed to the sheet inductor confronting the designated sorting tray, so that the sheet can be successfully introduced into the designated sorting tray along the sheet inductor without being hindered by the preceding sheet or sheets existing in the designated sorting tray due to the sheet pressure members mounted on the sheet inductor.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

FIG. 5 is a schematic side view showing a sheet pressure member in the device of the invention.

FIG. 6 is a schematic plane view showing the sheet pressure member in the device of the invention.

DESCRIPTION OF THE PREFERRED EMBODIMENTS

Figure 1:
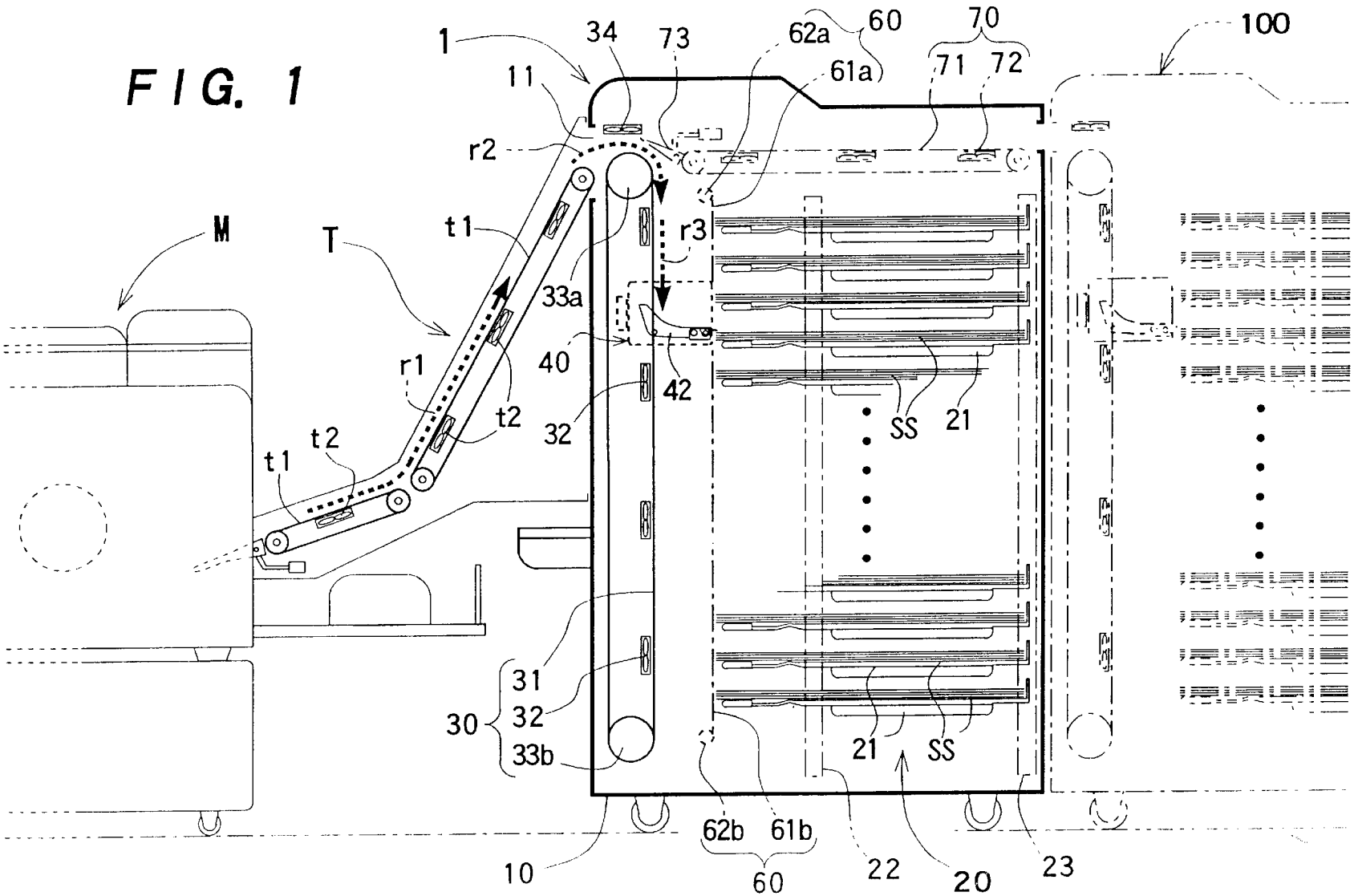
FIG. 1 is a side section schematically showing a sheet sorting device according to this invention.

This invention relates to a sheet sorting device for stably and reliably distributing copy sheets or printed sheets discharged from a copying machine, various types of printers or the like into multi-stage sorting trays at high speed, so as to produce a plurality of sets of sheets collated in paging order. The reliable function of distributing the sheets into the multi-stage sorting trays is fulfilled by one or more sheet pressure members for pressing down the preceding sheet or sheets already introduced into the sorting tray when introducing the following sheet into the sorting tray. The sheet sorting device with the sheet pressure members of the invention will be described in detail hereinafter with reference to one exemplary embodiment of the invention illustrated in the drawings.

The sheet sorting device 1 of the invention is connected with an image forming device M through a sheet transport system T as illustrated in FIG. 1. In the illustrated embodiment, a copying machine is adopted as the image forming device M, but printers of various kinds including a printing machine and a laser printer may be used instead.

As one example, the sheet transport system T includes two sheet transporting means linked to each other, each comprising a perforated endless belt t1 and suction means t2 for attracting the sheet to be transported to the belt t1.

According to this sheet transport system T, the sheet S can be transported without bringing the printed face of the sheet into contact with the belt t1. Thus, even if an image on the sheet is printed with ink and not completely dried yet, it is not spoilt by the transporting means. Consequently, the printed sheets can be continuously transported at high speed.

However, the sheet transport system is by no means limited only to the illustrated structure and may be of any other sheet transporting means. It is a matter of course that the sheet transport system may be excluded if the sorting device 1 of the invention is linked directly to the image forming device M. As another measure, the sorting device of the invention may be assembled into the image forming device. In a word, only the condition in which the sheets S are consecutively sent into a sheet entrance 11 of the sheet sorting device 1 of the invention suffices for the purpose of this invention. Thus, the detailed description of the image forming device M and the sheet transport system T is omitted below.

The sheet sorting device 1 of the invention comprises a housing 10 having the aforesaid sheet entrance 11, a tray unit 20 including the sorting trays 21 for storing the sheets, which are designated to receive the sheet one after another, a sheet transport means 30 for transporting the sheet S in the vertical direction in which the sorting trays aligned in multiple stages, a sorting unit 40 including a sheet inductor 42 for guiding the sheet transported by the sheet transport means 30 to the designated one of the sorting trays, and means 44 for driving the sheet inductor 42 along the sheet receiving portion 20*a* defined along the aligned sorting trays 21, and one or more sheet pressure members 50 mounted on the sheet inductor 42.

The tray unit 20 includes lateral-edge adjusting means 22 for truing up the lateral edges of the sheets SS stacked on the sorting trays 21, and longitudinal-edge adjusting means 23 for truing up the front edges (right-hand ends in FIG. 1) of the sheets SS stacked on the sorting trays.

The sorting trays 21 each held in the substantially horizontal state are arranged in parallel to one another so as to form a space (interval D) between the vertically adjoining trays. The space D may be made somewhat larger than the maximum thickness of the desired sheaf of sheets SS to be resultantly obtained. In general, the maximum thickness of the desired sheets SS is determined by the leg height of a staple for use in an automatic stapling or bookbinding device (not shown) which is possibly assembled into a sheet sorting device of the type described herein, or other sheet handling conditions. However, in this invention, the space D can be reduced to the minimum due to the sheet pressure members 50 as described later.

The sheet transport means 30 in this embodiment is similar to the aforementioned sheet transport system T shown in FIG. 1 and serves to send the sheet fed from the image forming device M touched upon above to the sorting unit 40. The transport means 30 includes perforated feed belts 31, suction means 32 disposed close to the feed belts 31 for attracting the sheet S to the feed belts 31, and wheels 33*a* and 33*b* for supporting and driving the feed belts 31. According to this transport means 30, the sheet S given from the image forming device M can be transported to the sorting unit 40 and further to the designated sorting tray 21 without bringing the image face of the sheet into contact with the feed belts 31.

Figure 4:
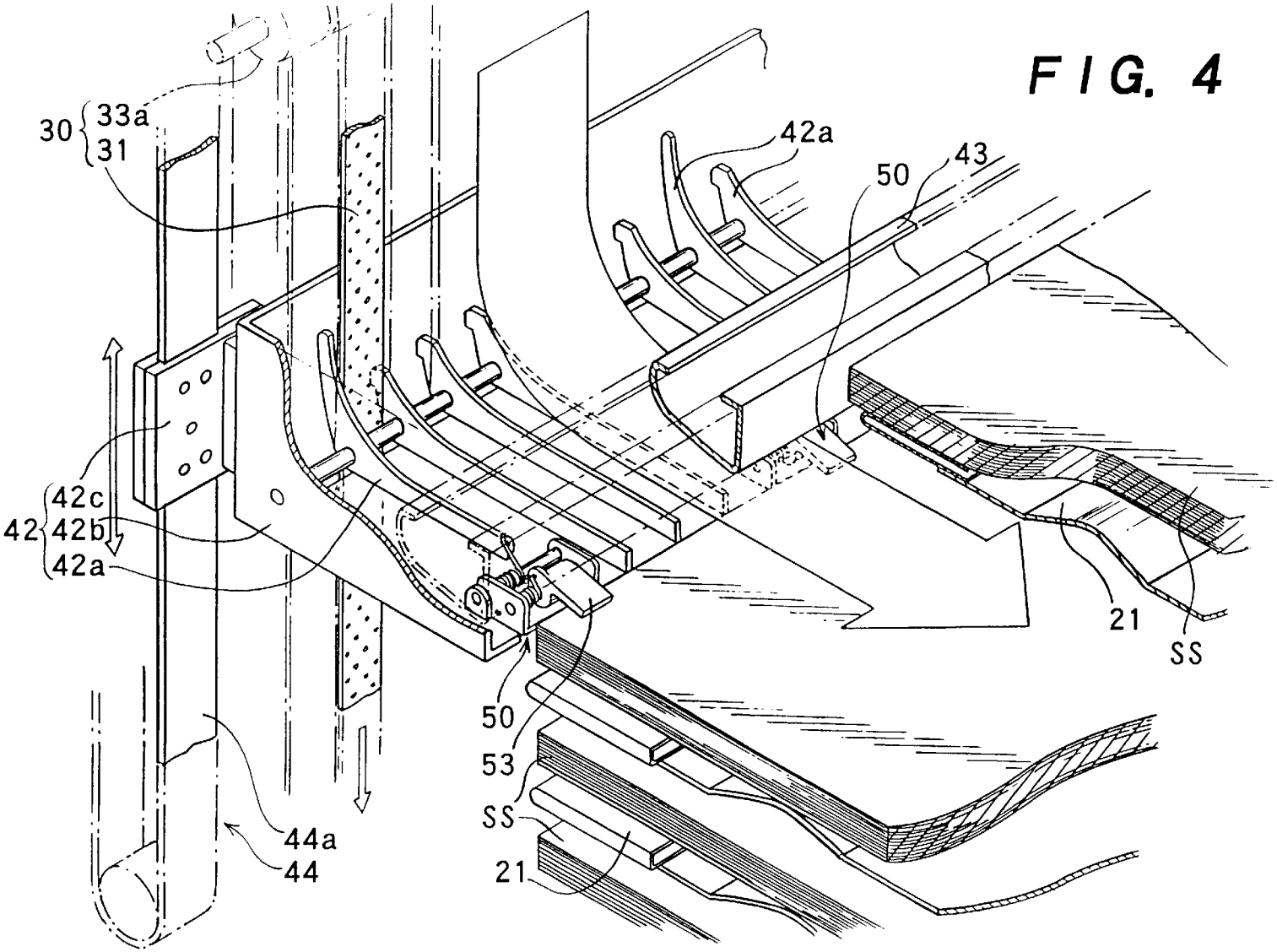
FIG. 4 is a partially sectioned perspective view schematically showing, in part, the sorting unit in the device of the invention.
Figure 7:
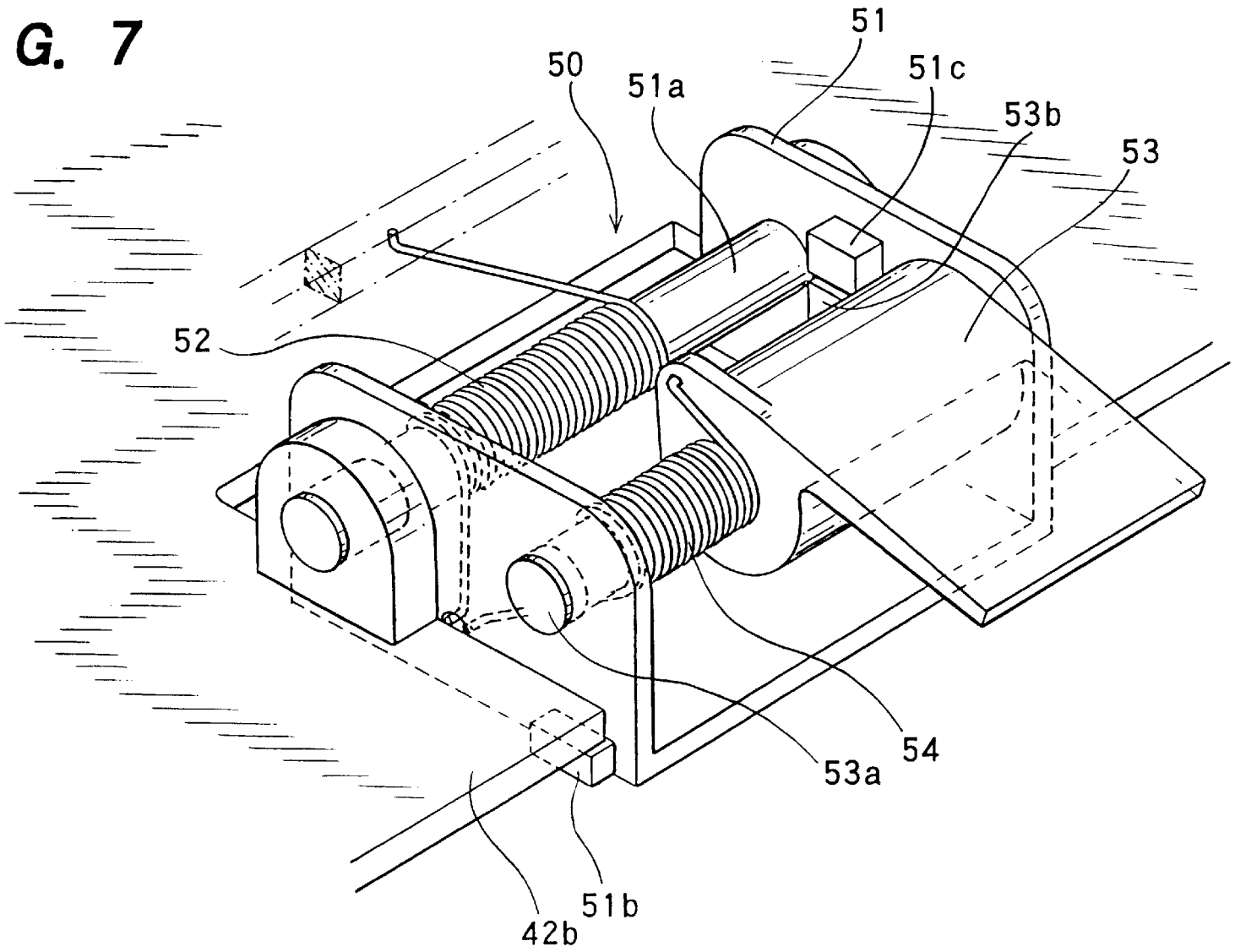
FIG. 7 is a schematic perspective view showing the sheet pressure member in the device of the invention.

The feed belts 31 each made of an endless slender strip are placed side by side in the width direction of the device as shown in FIG. 4, but the number of the belts is not specifically limited.

At the sheet entrance 11 through which the sheet is introduced into the sorting device 1 via the sheet transport system T, there is disposed an air blower 34 for pressing the sheet against the feed belts 31 so as to send the sheet fed through a sheet passage r1 in the sheet transport system T to a sheet passage r3 through a sheet passage r2. Such component elements constituting the sheet transport means 30 should not be understood as limitative.

The sorting unit 40 disposed between the tray unit 20 and the sheet transport means 30 is moved vertically along the sheet receiving portion 20*a* and stopped so that the sheet inductor 42 is directed to the designated sorting tray 21 to introduce the sheet S sent by the sheet transport means 30 into the designated sorting tray 21.

The sheet inductor 42 has guide ribs 42*a* arranged in parallel in the width direction on an inductor frame 42*b* for guiding the sheet S vertically sent along the passage r3 to the designated sorting tray 21. The guide rib 42*a* has an upper guide edge gradually curved so as to turn the sheet S vertically sent to the horizontal direction.

In the drawings, reference numeral 42*c* denotes connectors for connecting the sheet inductor 42 with the inductor driving means 44.

Figure 2:
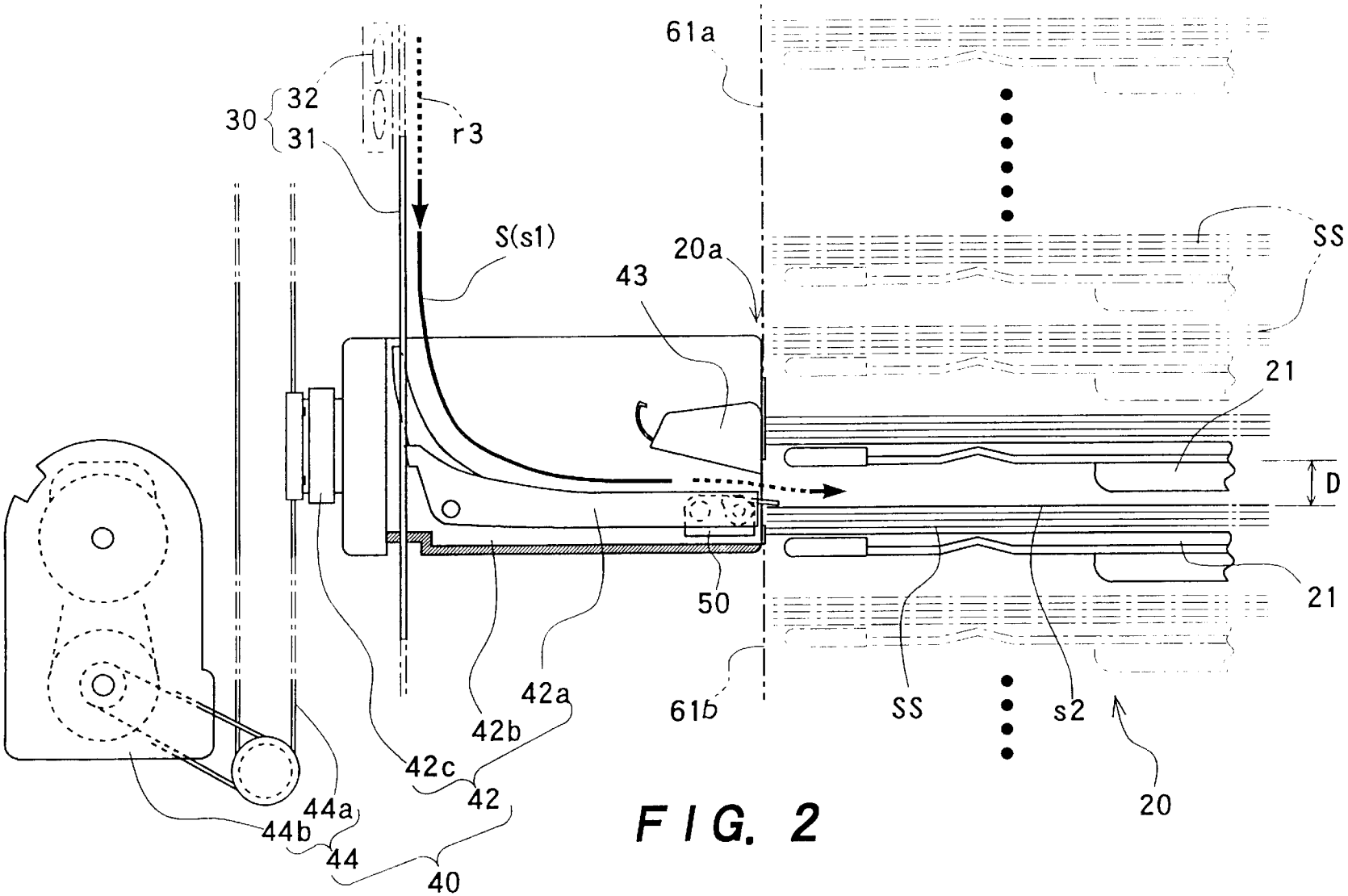
FIG. 2 is a schematic side view showing a sorting unit in the device of the invention.

The feed belts 31 are placed between the rear end portions of the adjoining guide ribs 42*c* (FIGS. 2 and 3), so that the sheet S sent by the feed belts 31 is transferred onto the guide ribs 42*a*. Although the sheet S, which is transferred from the feed belts 31 onto the guide ribs 42*a* and released from the feed belts 31, does not receive a forwarding force from the feed belts 31, it runs into the designated sorting tray by inertia at high speed.

Denoted by 43 is a guide member disposed above the guide ribs 42*a*.

The inductor driving means 44 for moving the sheet inductor 42 upward and downward includes means 44*a* for vertically driving endless timing belts 42*b* each connected to the connector 42*c* of the inductor frame 42*b*, and means 44*b* for driving and controlling the moving means 44*a* so as to permit the moving means 44*a* to move to and stop at a prescribed position.

The sheet pressure member 50 mounted on the sheet inductor 42 serves to press down the rear end portion of the preceding sheet s2 already introduced into and placed on the designated sorting tray 21, so that the following sheet s1 which is sent along the guide ribs 42*a* and approaches the designated sorting tray 21 can successfully enter into the designated sorting tray 21 without being hindered by the preceding sheet s2.

As shown in FIG. 5 and FIG. 6, the sheet pressure member 50 comprises a rocking frame 51 supported rotatably about an axial shaft 51*a* on the inductor frame 42*b* of the sheet inductor 42, and a pressure flap 53 supported rotatably about an axial shaft 53*a* on the rocking frame 51.

The rocking frame 51 is energized by a first spring 52 so as to usually assume its substantially horizontal posture by means of a stopper 51*b* colliding with the inductor frame 42*b*, but it stoops down against the first spring 52 when the sheet inductor 42 moves upward. Namely, at that time, the rocking frame 51 rotates in the direction indicated by the arrow a1 in FIG. 5.

The pressure flap 53 is energized by a second spring 54 to usually assume its substantially horizontal posture by means of a stopper 53*b* colliding with a projection 51*c* formed on the rocking frame 51, but it turns upward against the second spring 54 when the sheet inductor 42 moves downward. Namely, at that time, the pressure flap 53 rotates in the direction indicated by the arrow a2 in FIG. 5.

Figure 8A:
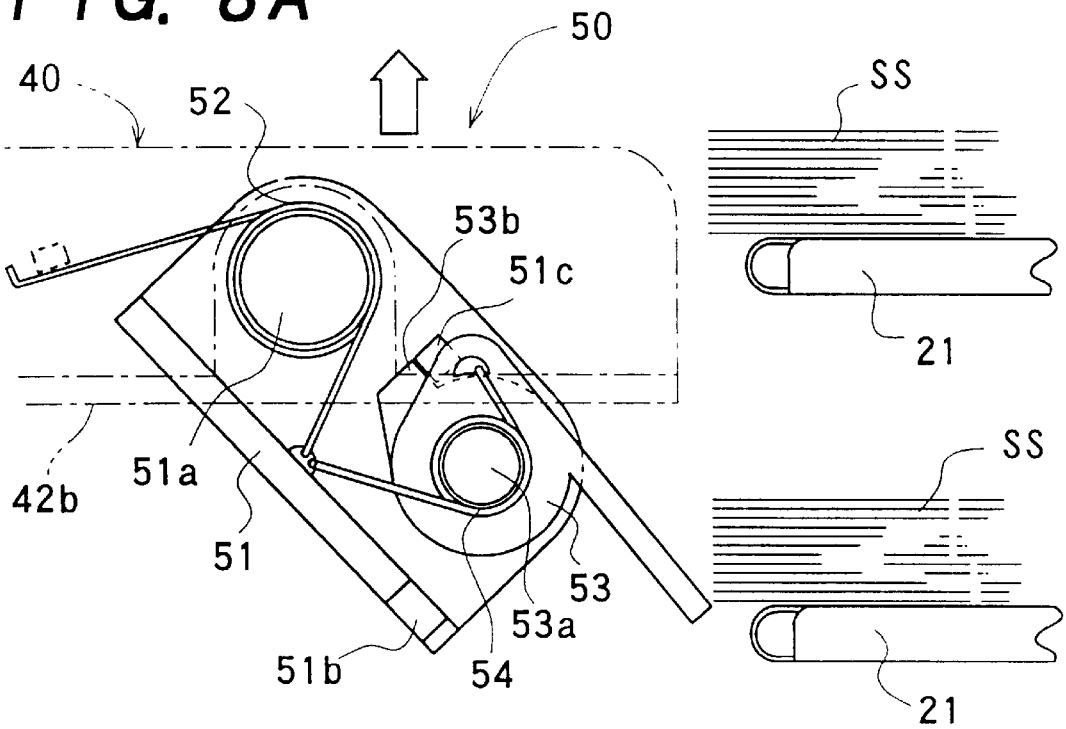
FIG. 8A and FIG. 8B are explanatory diagrams showing the operating principle of the sheet pressure member of the invention.
Figure 8B:
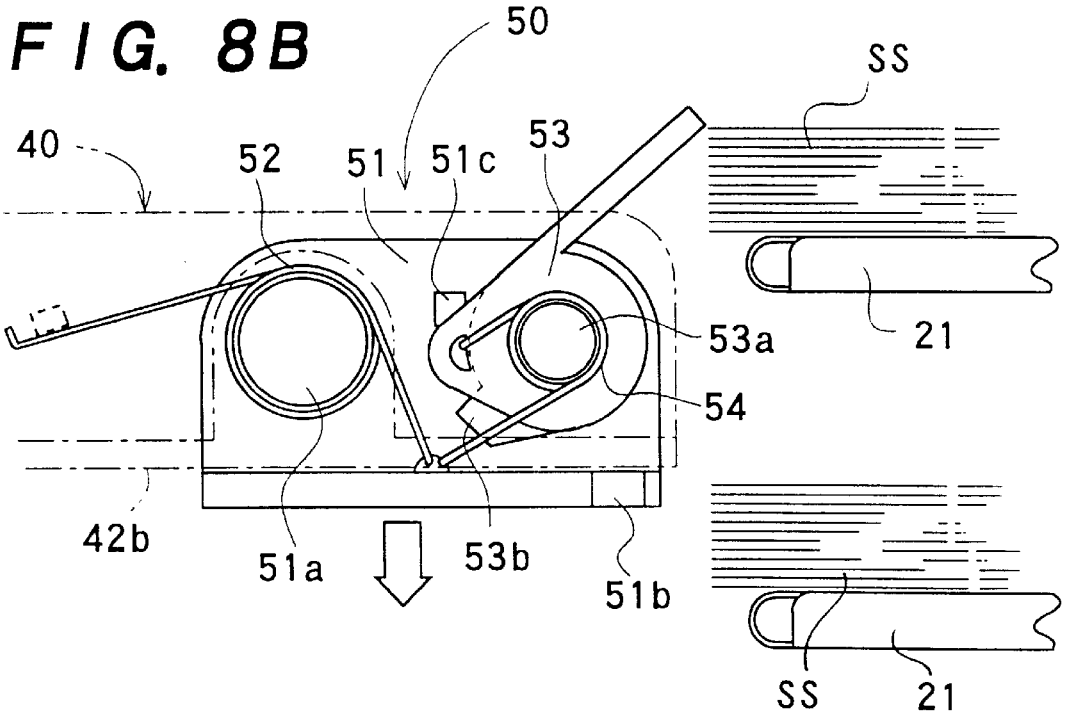

Thus, when the sheet inductor 42 moves up and down during the sorting operation, the sheet pressure member 50 is directed downward (FIG. 8A) and upward (FIG. 8B), thus to evade the sheets stacked on the sorting tray so as not to impede the vertical movement of the sheet inductor 42. Besides, the sheets consecutively fed from the image forming device can be successfully distributed into the sorting trays without decreasing the processing speed and causing any hindrances such as sheet jams or mis-feeding, since one or more sheets on the sorting tray are stably pressed down by the sheet pressure members 50 no matter how much the sheet is curled or deformed. Consequently, the performance and reliability of the sorting device can be heightened to the utmost limit.

Figure 3:
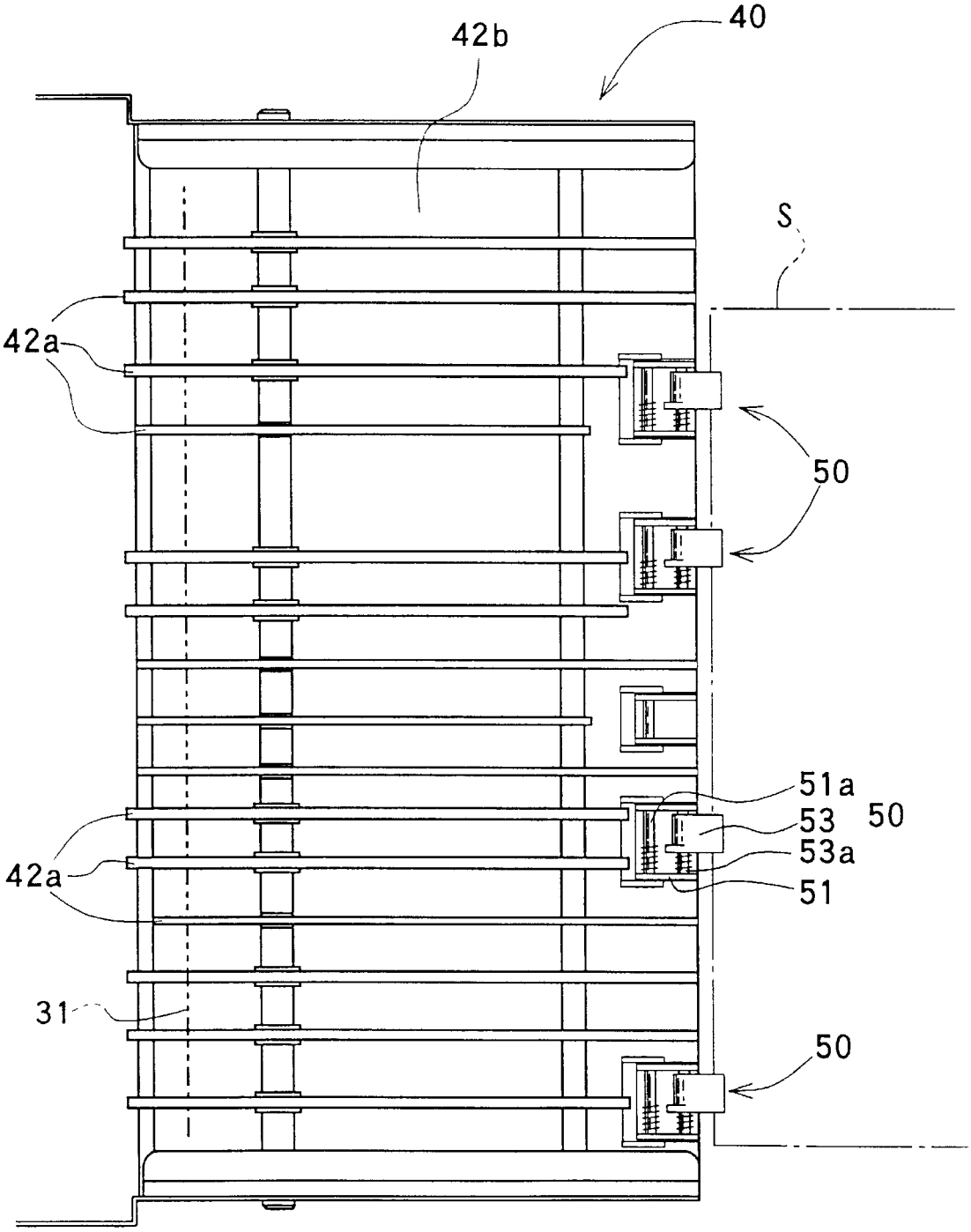
FIG. 3 is a schematic plan view showing a sheet inductor in the device of the invention.

The sheet pressure members 50 are disposed along the front edge, portion of the sorting unit 40 at the intervals determined in accordance with the width of the sheet to be handled, as shown in FIG. 3. Although the intervals at which the sheet pressure members 50 are placed and the number of the sheet pressure members 50 are not specifically limited, it is desirable to reduce the intervals of the adjoining sheet pressure members 50 to effectively press down the sheet or sheets on the sorting tray.

The order of introducing the sheets given from the image forming device into the sorting trays is not defined. That is, the sheets may be distributed into the trays in the order from the upper tray to the lower tray, and vice versa.

By 60 is denoted means for retaining the sheaves of sheets-stacked on the sorting trays 21. The sheet retaining means 60 comprises tension screens 61*a* and 61*b* fastened respectively to the upper and bottom portions of the sorting unit 40, and winders 62*a* and 62*b* for retractably tolling up the tension screens 61*a* and 61*b*. Due to tension screens 61*a* and 61*b*, the sheaves of the sheets SS stored in the sorting trays 21 are prevented from protruding out of the sorting trays, thus exactly positioning and truing up the rear ends of the sheets at the sheet receiving portion.

It is desirable that the strength of the first spring 52 for energizing the rocking frame 51 is weakened to the extend of usually holding the rocking frame 51 in the substantially horizontal posture, but preventing the pressure flap 53 from affecting the sheets on the sorting tray when the sorting unit moves vertically.

The second spring 54 for energizing the pressure flap 53 is possessed of moderate resilience so as to securely press down the sheet or sheets even if rigidly curled on the sorting tray.

In the sorting device of the invention, the sorting unit 40 momentarily stops confronting the designated sorting tray 21 when the sheet is introduced into the designated sorting tray. To accurately stop the sorting unit 40 at the designated sorting tray 21, there may be adopted an automatic controlling system including a servo mechanism capable of operating the sheet pressure members 50 in accordance with the property of the sheet to be handled, the number of the sheets introduced on the sorting tray and other conditions, or a mechanical drive system for mechanically stopping the sorting unit 40 while distributing the sheets consecutively given from the image forming device.

Particularly in the sorting device using the system for mechanically driving and stopping the sorting unit 40, it is desirable to determine the resiliencies of the first spring 52 and the second spring 54 to the respective optimum degrees to suitably press down the sheet or sheets on the sorting tray.

Figure 9A:
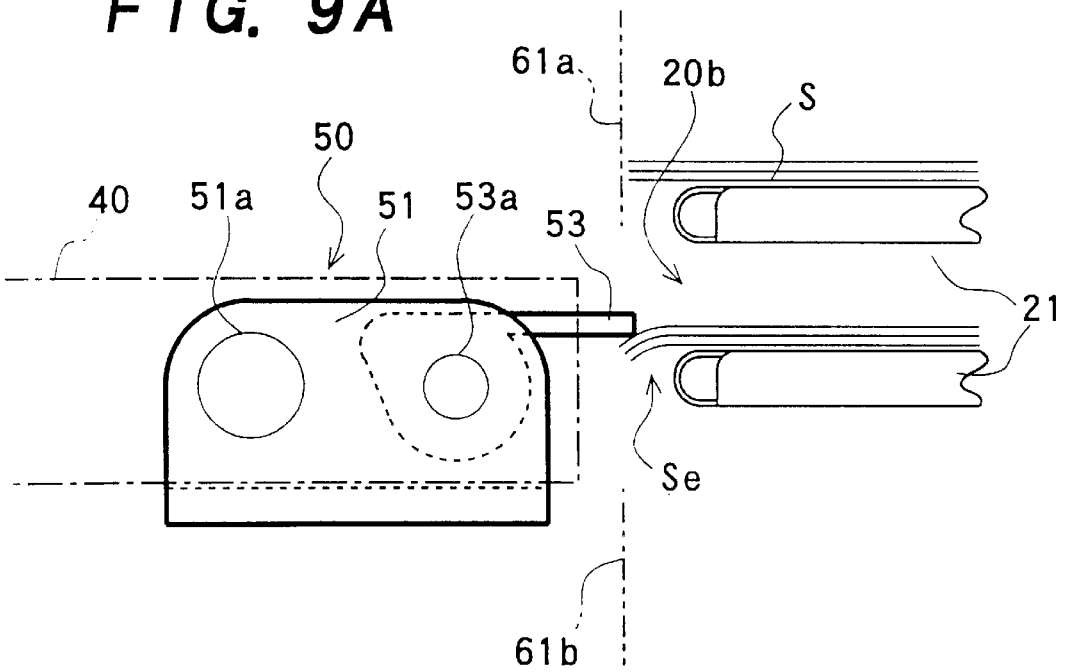
FIG. 9A and FIG. 9B are schematic views showing different postures of the sheet pressure member of the invention.

To be more specific, the rear end portion of the sheaf of sheets on the sorting tray protrudes backward (leftward in the drawings) from the sorting tray so as to be positioned in the space defined between the sorting unit 40 and the sorting trays 21, in which the tension screens 61*a* and 61*b* of the sheet retaining means 60 are spread retractably. When there are not many sheets on the designated sorting tray 21, the rear end portion of the sheaf of sheets on the tray is easily bent downward by the resilient pressure of the pressure flap 53 as shown in FIG. 9A, thus to make a sheet introduction opening 20*b* wide sufficiently. Consequently, the sheet can smoothly and stably enter the sorting tray 21.

Figure 9B:
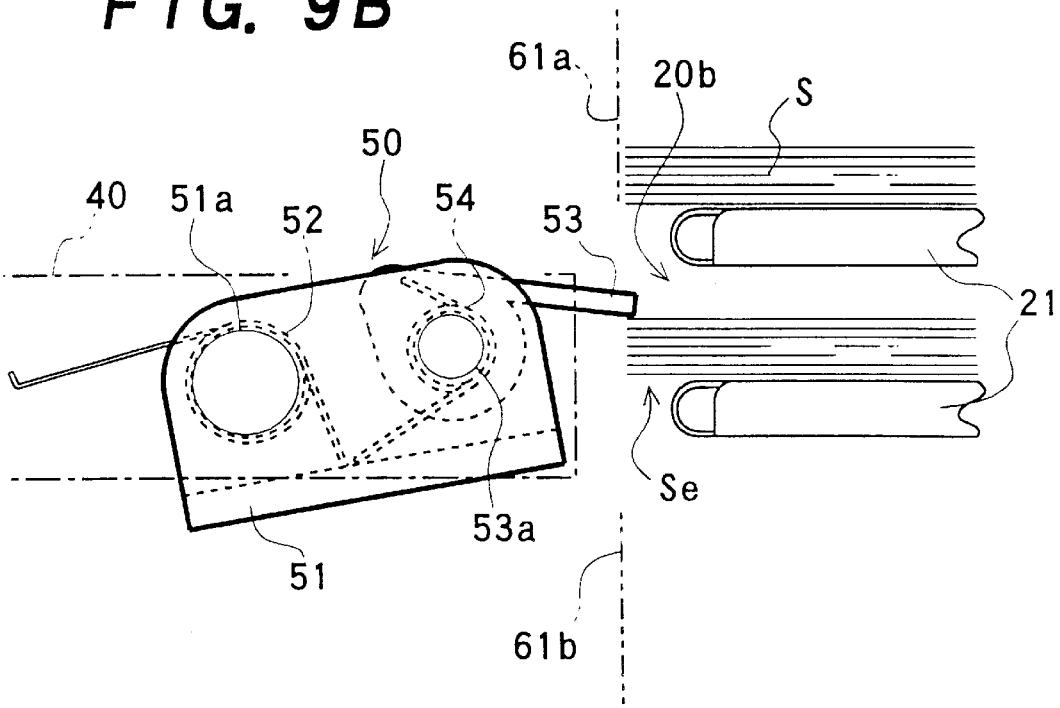

As the number of the sheets consecutively given is increased, the thickness and rigidity of the sheets on the sorting tray are increased, as a result of which the rear end portion of the sheaf of sheets on the sorting tray is little bent by the downward force imparted by the pressure flap 53. However, the rocking frame 51 energized by the first spring 52 and the pressure flap 53 energized by the second spring 54 are operatively associated with each other so as to widen the sheet introduction opening 20*b* as shown in FIG. 9B, thus to prevent the pressure flap 53 from being directed upward so as not to hinder the sheet to be introduced into the sorting tray.

Accordingly, with the first spring 52 energizing the rocking frame 51 and the second spring 54 energizing the pressure flap 53, the sheet pressure member 50 including the pressure flap 53 can be constantly maintained in its most suitable state to smoothly introduce the sheet into the designated sorting tray in spite of the number of the sheets stacked on the sorting tray.

Incidentally, the pressure flap 53 made shorter must more stably and moderately press down the sheets stacked on the sorting tray in comparison with that having a longer projecting portion.

As is apparent from the foregoing description, the sorting unit 40 vertically moves stepwise to direct the sheet inductor 42 to the sorting trays 21 designated in turn concurrently with the consecutive feeding of the sheets from the image forming device, while introducing the sheets into the designated sorting trays 21 one by one. At this time, the preceding sheet or sheets earlier introduced into and stacked on the designated sorting tray 21 are securely pressed down by the sheet pressure members 50, the following sheet to be introduced into the designated sorting tray 21 can successfully enter the designated sorting tray without being hindered by the sheet or sheets already stacked on the sorting tray.

Although the ability to produce the sheaves of sheets of the sorting device depends on the number of the sorting trays, it can be developed by installing more sorting devices as shown by the imaginary line in FIG. 1. That is, a supplementary sorting device 100 similar to the sorting device 1 described above may be added. In this case, the first sorting device 1 necessitates provision of an auxiliary sheet transport means 70 for sending the sheets exceeding the capacity of the first sorting device 1 to the supplementary sorting device 100. The auxiliary sheet transport means 70 includes perforated feed belts 71, suction means 72 disposed close to the feed belts 71 for attracting the sheet to the feed belts 71, and a switch means 73 for selectively directing the sheet to either of the first sorting device 1 and the supplementary sorting device 100. Likewise, more supplementary sorting devices may be added to further increase the ability of the sheet sorting device.

In addition, the sheet sorting device of the invention may be provided with an automatic stapling mechanism for automatically stapling the sheets stacked on the sorting trays to make an automatic bookbinding or finishing system.

As is described above, according to the sheet sorting device of the invention, since the sheet or sheets introduced into the sorting tray are stably pressed down by the sheet pressure members 50 mounted on the sheet inductor 42, the sheets consecutively fed from the image forming device can be successfully distributed into the sorting trays without causing any hindrances such as sheet jams or mis-feeding under any sheet feeding conditions. The function of stably distributing the sheets can be fulfilled even if narrowing the space between the adjoining sorting trays aligned vertically. Thus, a high-performance sheet sorting device having a reduced size and an enhanced ability to handle the sheets can be obtained according to the invention. Moreover, the sheet sorting device is easily applicable to various image forming or handling devices such as copying machines and various types of printers, and serves to rationally distribute the sheets fed from the image forming device without degrading the performance and ability of the image forming device.

It is to be understood that the invention is not limited in its application to the details of construction and arrangement of parts illustrated in the accompanying drawings, since the invention is capable of other embodiments and of being practiced or carried out in various ways. Also it is to be understood that the phraselogy or terminology employed herein is for the purpose of description and not of limitation.

What is claimed is:

1. A sheet sorting device comprising;

a tray unit including sorting trays having one ends along which a sheet receiving portion is formed;

means for transporting a sheet;

a storing unit disposed between said tray unit and said transporting means, said sorting unit including a sheet inductor for introducing the sheet transported by said transporting means into one of said sorting trays, which is designated to receive the sheet;

means for driving said sheet inductor along said sheet receiving portion; and one or more sheet pressure members disposed on said sheet inductor for pressing down one or more sheets stacked on said designated sorting tray when introducing the sheet transported by said transporting means into said designated sorting tray, and said sheet pressure member including rocking means responsive to movement of said inductor to move, said sheet pressure member between a position at which said sheet pressure member stoops down to press said one or more sheets stacked on said sorting tray and a position at which said sheet pressure member evades said sheets in accordance with movement of said inductor.

2. A sheet sorting device according to claim 1, wherein rocking means includes a rocking frame supported rotatably relative to said sheet inductor so as to usually assume its substantially horizontal posture and stoops down when said sheet inductor moves upward, and a pressure flap supported rotatably on said rocking frame so as to usually assume its substantially horizontal posture and turn upward when said sheet inductor moves downward.

3. A sheet sorting device according to claim 1, wherein said, rocking means includes a rocking frame supported rotatably relative to said sheet inductor, and first and second springs said rocking frame being energized by said first spring so as to usually assume its substantially horizontal posture and stoops down against said first spring when said sheet inductor moves upward, and a pressure flap supported rotatably on said rocking frame, said pressure flap being energized by said second spring so as to usually assume its substantially horizontal posture and turn upward against said second spring when said sheet inductor moves downward.

4. A sheet sorting device according to claim 1, wherein said sheet pressure member is positioned coming in press contact with said one or more sheets on said sorting tray when introducing a following sheet into said sorting tray and separated from said sheets stacked on said sorting unit so as to evade said sheets when said inductor moves vertically.

5. A sheet sorting device comprising:

a tray unit including sorting trays held substantially horizontally in parallel to one another and aligned substantially vertically in multiple stages so as to have one ends along which a sheet receiving portion is formed, means for transporting a sheet, a sorting unit disposed movably vertically between said tray unit and said transporting means, said sorting unit including a sheet inductor for introducing the sheet transported by said transporting means into one tray of said sorting trays, which one tray is designated to receive the sheet, an inductor frame for retaining said sheet inductor, and means for driving said sheet inductor along said sheet receiving portion, and one or more sheet pressure members disposed on said sheet inductor and including a rocking frame and means for pivotably supporting said rocking frame relative to said sheet inductor so as to usually assumes its substantially horizontal posture and stoops down when said sheet inductor moves upward, and a pressure flap supported rotatably on said rocking frame so as to usually assume its substantially horizontal posture and turn upward when said sheet inductor moves downward, thereby to press down one or more sheets stacked on said designated sorting tray when the sheet transported by said transporting means is introduced into said designated sorting tray.

6. A sheet sorting device according to claim 5, wherein said rocking frame is energized by a first spring and provided with a stopper usually colliding with said inductor frame so as to bring said rocking frame in its substantially horizontal state, said pressure flap is energized by a second spring and a stopper, and said rocking frame has a projection with which said stopper of said pressure flap usually collides so as to bring said pressure flap in its substantially horizontal state.

7. A sheet sorting device according to claim 5 wherein said transport means includes perforated feed belts, suction means disposed close to said feed belts for attracting the sheet to said feed belts, thereby to transport the sheet having an image face without bringing the image face of said sheet into contact with said feed belts.

8. A sheet sorting device according to claim 5, further comprising sheet retaining means disposed between said sorting unit and said tray unit for retaining the sheets stacked on said sorting tray, said sheets having rear ends, said sheet retaining means including tension screens fastened to said sorting unit and winders for rolling up said tension screens in accordance with horizontal movement of said sorting unit to come in press contact with said rear ends of said sheets for truing up said rear ends of said sheets.

9. A sheet sorting device according to claim 5, wherein said pressure flap is made shorter so as to moderately press down the sheets stacked on said sorting tray.

10. A sheet sorting device according to claim 5, wherein said sheet pressure members are disposed on the sorting unit at intervals determined in accordance with the sheet to be introduced into said sorting tray.

11. A sheet sorting device comprising a tray unit including sorting trays having one ends along which a sheet receiving portion is formed, a sheet inductor for introducing the sheet into one of said sorting trays, means for transporting sheets to said sorting trays, means for driving said sheet inductor along said sheet receiving portion, and one or more sheet pressure members disposed on said sheet inductor for pressing down one or more sheets stacked on said designated sorting tray when introducing the sheet into said sorting tray, said sheet pressure member including a rocking frame and means for pivotably supporting said rocking frame relative to said sheet inductor so that said rocking frame usually assumes its substantially horizontal posture and stoops down when said sheet inductor moves upward, and a pressure flap supported rotatably on said rocking frame so as to usually assume its substantially horizontal posture and turn upward when said sheet inductor moves downward.

12. A sheet sorting device comprising a tray unit including sorting trays having one ends along which a sheet receiving portion is formed, a sheet inductor for introducing the sheet into one of said sorting trays means for transporting sheets to said sorting trays, means for driving said sheet inductor along said sheet receiving portion, and one or more sheet pressure members disposed on said sheet inductor for pressing down one or more sheets stacked on said designated sorting tray when introducing the sheet into said sorting tray, said sheet pressure member including a rocking frame and means for pivotably supporting said rocking frame relative to said sheet inductor, said rocking frame being energized by a first spring so that said rocking frame usually assumes its substantially horizontal posture and stoops down against said first spring when said sheet inductor moves upward, and a pressure flap supported rotatably on said rocking frame, said pressure flap being energized by a second spring so as to usually assume its substantially horizontal posture and turn upward against said second spring when said sheet inductor moves downward.

* * * * *